US006209569B1

(12) United States Patent
Sharp

(10) Patent No.: US 6,209,569 B1
(45) Date of Patent: Apr. 3, 2001

(54) SAFETY SHUT-OFF VALVE ASSEMBLY FOR A FUEL DISPENSER

(76) Inventor: Bruce R. Sharp, 321 Ski Way Box 5867, Incline Village, NV (US) 89450

( * ) Notice: Subject to any disclaimer, the term of this patent is extended or adjusted under 35 U.S.C. 154(b) by 0 days.

(21) Appl. No.: 09/431,317

(22) Filed: Nov. 2, 1999

Related U.S. Application Data

(63) Continuation-in-part of application No. 08/933,462, filed on Sep. 18, 1997, now Pat. No. 5,975,110.

(51) Int. Cl.[7] ..... G01M 3/04

(52) U.S. Cl. ..... 137/234.6; 137/68.12; 137/68.14

(58) Field of Search ..... 137/68.14, 68.12, 137/234.6

(56) References Cited

U.S. PATENT DOCUMENTS 2,898,926 * 8/1959 Tsiguloff ..... 137/68.14
2,906,280 * 9/1959 Mount ..... 137/68.14
2,910,080 * 10/1959 Wright et al. ..... 137/68.14
4,047,548 * 9/1977 Wagner ..... 141/52
5,054,523 10/1991 Rink .
5,098,221 3/1992 Osborne .
5,975,110 * 11/1999 Sharp ..... 137/234.6

* cited by examiner

*Primary Examiner*—A. Michael Chambers
(74) *Attorney, Agent, or Firm*—Charles R. Wilson

(57) ABSTRACT

A safety shut-off valve assembly is especially for use with a dispenser unit used at retail gasoline service stations. The shut-off valve assembly comprises an open-top fuel flow chamber for permanent mounting at a base of the fuel dispenser, a removable cover plate with a break-away tube member extending therefrom, and a bonnet valve mounted in the open-top fuel flow chamber. An ingress opening in the fuel flow chamber receives a terminus of a primary supply pipeline. The terminus of the break-away tube member serves as an egress for the fuel. The bonnet valve has a plate disc to close off the break-away tube member terminus when needed. When the dispenser unit is disturbed such as by an accidental bumping, the bonnet valve is activated to prevent further flow of fuel into the dispenser unit. The assembly prevents an accumulation of fuel vapors and allows ready access to the primary pipeline for periodic inspection or replacement.

16 Claims, 3 Drawing Sheets

SAFETY SHUT-OFF VALVE ASSEMBLY FOR A FUEL DISPENSER

This is a continuation-in-part of "Adapter Assembly For Accessing Primary Pipeline Of A Double Wall Pipeline System", Ser. No. 08/933,462, filed Sep. 18, 1997, now U.S. Pat. No. 5,975,110.

FIELD OF THE INVENTION

This invention relates to a safety shut-off valve assembly for use with a fuel dispenser unit. More particularly, the invention relates to a safety shut-off valve assembly for connecting a terminus of a supply primary pipeline to a ground level gasoline station dispenser unit in a manner whereby periodic assess to the primary pipeline is provided.

BACKGROUND OF THE INVENTION

Many local, state and federal agencies require that underground storage tank systems for hazardous materials be secondarily contained. The systems generally include an underground tank, a pump containment sump located on top of the tank, and piping from the containment sump to a ground level dispenser unit. Double walled pipeline systems have recently become popular and in some locales are mandated for underground conveyance of the hazardous material. Such pipeline systems include an inner primary pipeline and an outer secondary pipeline for containing any leakage from the primary pipeline. Inclusion of a leak detection means which monitors for leakage from the inner primary pipeline is a further feature which enhances the systems. In fact, the double walled pipeline systems with leak detection capability for the primary pipeline is a cost effective way of meeting governmental leak detection requirements.

As a part of mandated safety requirements, many ground level dispenser units have pans, sometimes called dispenser sumps, at their base. The primary pipeline from the underground tank is normally under pressure when any dispenser (s) is dispensing fuel to a vehicle. Therefore, it is necessary to have an emergency safety shut-off valve interposed in the primary pipeline to stop the flow of gasoline in an emergency situation. That is, the valve is designed to close when either the dispenser unit is knocked off its mounting or a fire is started. The pan under each dispenser unit provides an area to access the primary pipeline and to install the safety valve. It also provides an area to access and replace the primary pipeline below the valve as well as to access piping above the valve which leads through the dispenser unit. U.S. Pat. No. 5,098,221, FIG. 7 illustrates a typical safety shut-off valve.

Typical dispenser pans result in a large open area under each dispenser unit. The area can collect flammable liquids or vapors which create fire and explosion hazards. The dispenser pans are also prone to fill up with ground water or rain water leaking down into the pan. Some state or local codes prohibit the secondary pipeline of the double walled pipeline system to terminate in an open manner to the interior of the dispenser pan. This is to prevent a collection of liquid or vapors which enters the pan from spreading through the secondary pipe and to the tank containment sump. As readily imagined, this is to prevent the spread of a fire emanating in the dispenser unit to the tank containment sump and possible explosion in the containment sump. The use of dispenser pans is further complicated in that most fire codes require the part of the primary pipeline of the double wall pipeline system which is within the pan to be steel piping or Underwriters Laboratories (UL) fire resistent piping. This means fiberglass and flexible plastic primary piping such as described in U.S. Pat. No. 5,098,221 must terminate underground before entering the dispenser pans.

All connector piping used within the dispenser pan must be fire resistent piping. This piping can be considerably more costly than the flexible piping used to convey the liquid from the storage tank to the dispenser pan. Because of leakage of water, flammable liquids or vapors into the dispenser pan, some fire codes require costly leak detection monitoring to detect leaks into the dispenser pan area. As mentioned above, many codes require the secondary pipeline connected to the pan be sealed so as not to let vapors/liquids from the pan into the secondary pipeline or the tank containment sump. In addition to all these requirements and precautions, dispenser pans are difficult and expensive to install in and under the concrete beneath the dispenser unit. They must be installed in a way to prevent rain or ground water from entering the pan. Many pipe and electrical conduit connections which lead into or from the dispenser pan require field installed seals. Historically, these seals have been problem areas of leakage of ground water into pans. Further heightening the problem is the fact it is costly to repair leaks into a dispenser pan during its operational life.

There are available dispenser units which do not have a dispenser pan. Secondary piping terminates in a liquid-tight sealed manner to a safety valve located at the dispenser's base. However, an associated disadvantage with this type of connection is that access to the primary pipeline is impeded. The primary pipeline is subject to deterioration and it is necessary to periodically remove it from within the secondary pipeline and replace it with new piping. Ideally, this is done without having to disconnect or disturb the secondary pipeline in any manner. It is necessary with known present systems to tamper with the secondary pipeline in any primary pipeline replacement process and this, as can be imagined, creates a whole set of new problems.

There now has been developed a safety shut-off valve assembly which allows for the installation, removal and replacement of a flexible primary pipeline which is connected to a dispenser unit base without unsealing and/or removing the secondary pipeline under the dispenser unit from the safety shut-off valve assembly. The valve assembly eliminates the need for a fire resistent primary pipeline between the flexible primary pipeline and the safety shut-off valve. The safety shut-off valve assembly further eliminates an accumulation of fuel vapors in the dispenser.

SUMMARY OF THE INVENTION

A safety shut-off valve assembly is operatively associated with a primary pipeline leading to a dispensing pipeline at a ground level gasoline service station dispenser unit. It can be used with a double wall pipeline system having the primary pipeline for conveying a liquid and a secondary pipeline substantially concentric with the primary pipeline to form an annular space for receiving leakage. The assembly comprises an open-top fuel flow chamber for permanent mounting at a base of the fuel dispenser, a removable cover plate for the open-top fuel flow chamber and having a break-away tube member, and a bonnet valve. The open-top fuel flow chamber has an opening to receive an outlet terminus of the primary supply pipeline as an ingress for the fuel. The break-away tube member in the cover plate has a terminus which serves as an egress through which fuel in the fuel flow chamber passes to the dispensing pipeline in the fuel dispenser unit. The bonnet valve allows the free flow of fuel to pass from the primary pipeline to the dispensing pipeline and shuts off the flow of fuel to the dispensing pipeline upon activation. The bonnet valve is disengageable from the fuel flow chamber to allow access to the primary pipeline for initial installation, removal and replacement purposes.

DETAILED DESCRIPTION OF THE INVENTION

Figure 1:
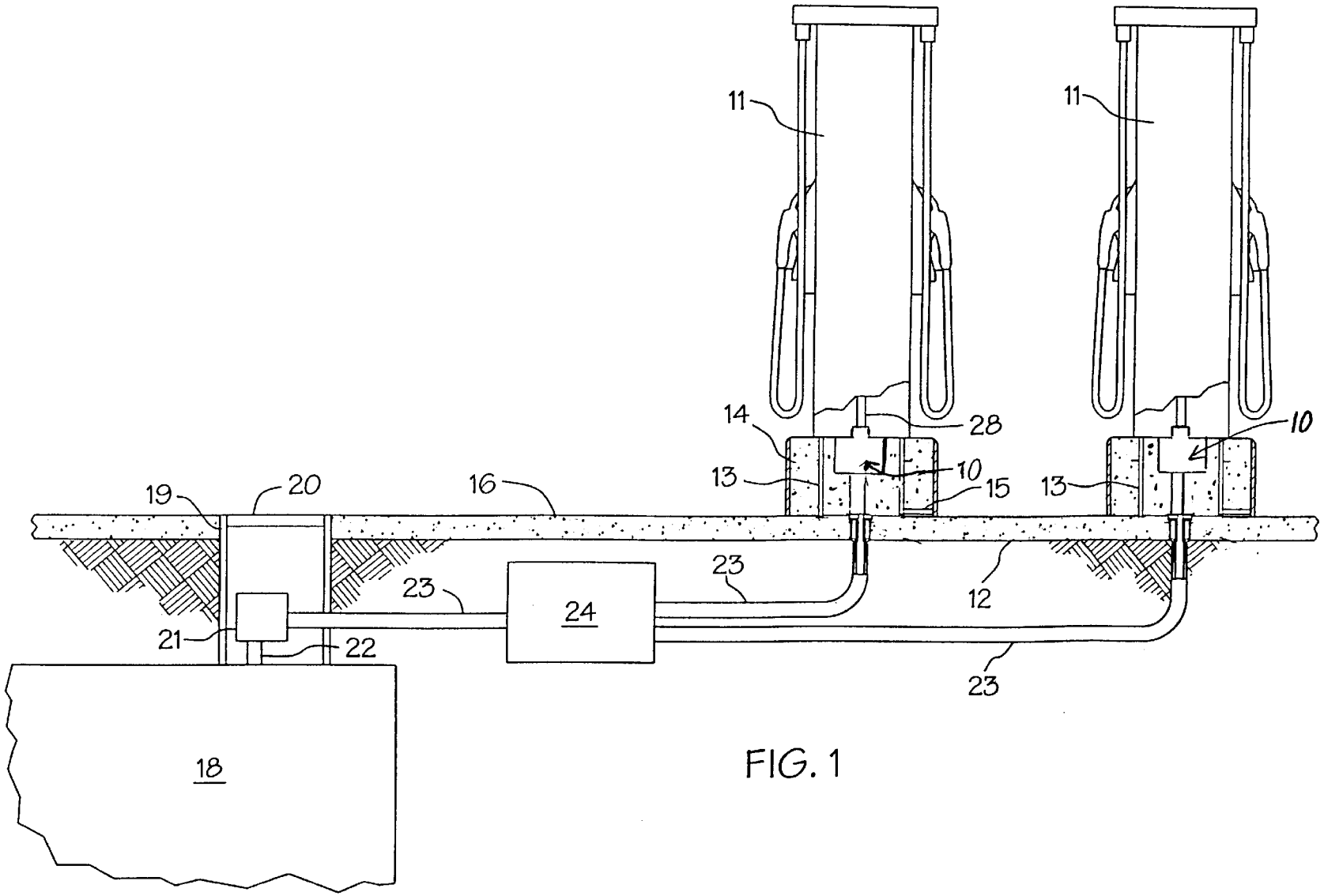
FIG. 1 is an environmental view partially in section showing a double wall pipeline system and a gasoline service station dispenser unit with a safety shut-off valve assembly of the invention.

The safety shut-off valve assembly of the invention finds its greatest use with ground level dispenser units such as found at retail gasoline service stations for filling fuel tanks of vehicles. For this reason, the shut-off valve assembly is described below and is illustrated in the drawings with reference to such dispenser units. It can as well be used with other dispenser units which control the flow of liquid from a bulk storage tank or other containment means and which dispense to commercial vehicles or other machinery.

The safety shut-off valve assembly of the invention is operably associated with the base of a gasoline dispenser unit. It is interposed between a primary supply pipeline and a dispensing pipeline in the dispenser unit. Most importantly, the safety shut-off valve assembly provides a means to install, remove and replace the primary pipeline from a double wall pipeline system without a need to disconnect the secondary pipeline. It also eliminates the need for a fire resistant connector pipeline between the primary supply pipeline and the dispensing pipeline.

As used herein, "base" of the dispenser unit is used to indicate a structure located at or below ground surface level and underneath the dispenser unit. Bases include a (1) a bottom well wall of the dispenser unit itself and (2) a concrete body, with or without a rigid island form, at an island station on which the dispenser unit is mounted. Removal of the dispenser unit or a side panel to the dispenser unit will typically expose the safety shut-off valve assembly of the invention.

With reference to FIG. 1, there is shown a safety shut-off valve assembly 10 of the invention positioned at the base of a dispenser unit 11. The base is a concrete body 12 and, as shown, preferably includes a bottom wall of a rigid island form 13 used in formation of a concrete island structure 14. The dispenser unit 11 itself is mounted on the concrete island structure 14. The concrete island structure extends up to about twelve inches above ground surface. It helps to protect the dispenser unit 11 and pipelines within and leading to it from damage by a vehicle. One or more drain holes 15 are preferably provided leading through the island form 13 and concrete island structure 14, to primarily drain rain water or leaked liquid which may collect within the area under the dispenser unit onto a concrete pad 16 of the service station.

The rigid island form 13 is used in formation of the concrete island structure and normally remains in the concrete body 12. The island form 13 is made of metal, though other materials rigid enough to retain their shape during formation of the dispenser unit base can be used. Together, the concrete body 12 and the bottom wall of the island form 13 provide the base of the dispenser unit depicted in FIGS. 1 and 2.

The dispenser unit 11 is secured to the concrete island structure 14 over the island form 13. The safety shut-off valve assembly 10 is at or below the top surface of the concrete island structure 14. As further discussed below the valve is designed to shut-off or close the primary pipeline upon the occurrence of a bumping sufficiently hard to cause structural damage or a fire at the dispenser unit. Further flow of gasoline from the primary supply pipeline to the dispensing pipeline within the dispenser unit is stopped.

The dispenser unit 11 has a panel (not shown) to access its interior for routine maintenance work on any component of the unit and to access the safety shut-off valve assembly and the primary pipeline. Gasoline hoses with fueling nozzles and a control panel are also a part of the dispenser unit and operate conventionally.

Still with reference to FIG. 1, an underground storage tank 18 is used to store the gasoline. It typically has a capacity of 10,000 to 20,000 gallons liquid, though can be smaller or larger. An access way 19 extends downwardly from ground surface, through the concrete pad 16, and to the top surface of the storage tank 18. A removable cover 20 is used to enter the access way 19 for periodic maintenance work on a pump 21 positioned in the access way 19 or piping 22 connecting the pump 21 to the storage tank 18. Access ways are further described in U.S. Pat. Nos. 5,134,878 and 5,136,877.

As shown, a double wall pipeline system 23 leads from the pump 21 through a wall of the access way 19 and to a distribution box 24. A manifold (not shown) or other distribution means within the distribution box 24 splits the flow of gasoline into separate pipelines which lead directly to one or more (two as shown) dispenser units 11. Alternatively, the access way 19 can serve as a distribution box with a distal end of the secondary pipeline beginning at the access way's wall. The pipeline system 23 could also be a single wall primary pipeline.

Figure 2:
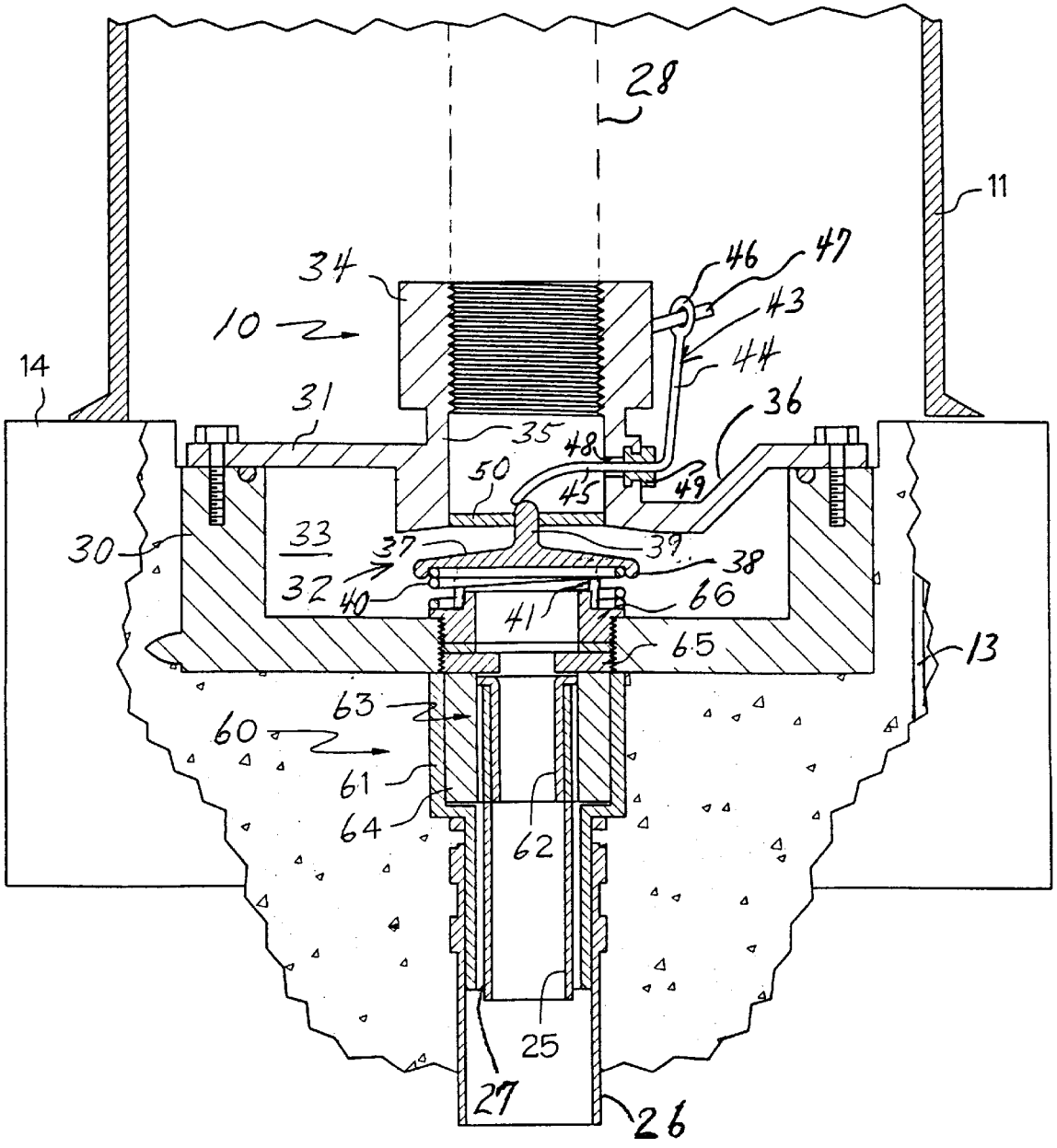
FIG. 2 is a side elevational view partially in section showing in detail the safety shut-off valve assembly of FIG. 1.
Figure 3:
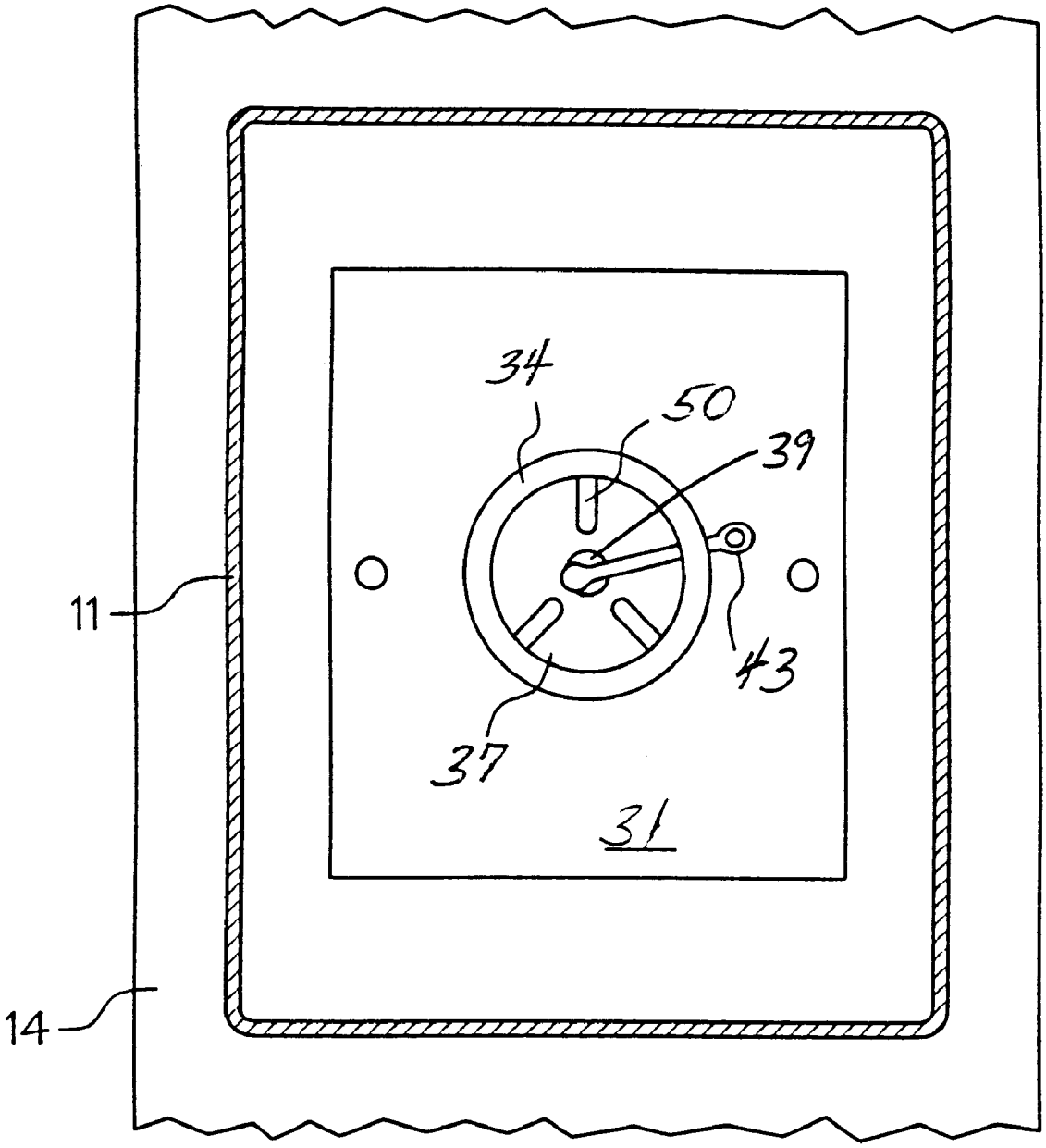
FIG. 3 is a top plan view partially in section of the safety shut-off valve assembly of FIG. 2.

As best seen in FIG. 2, the double wall pipeline system 23 includes a primary supply pipeline 25 which conveys the gasoline and a larger diameter secondary pipeline 26 substantially concentric therewith. The secondary pipeline serves to contain any gasoline which may leak from the primary pipeline. An annular space 27 is formed between the primary and secondary pipelines. The primary pipeline is semi-rigid or flexible in nature and is made of any suitable material, e.g. a plastic such as polyethylene, nylon, nitrel or tetrafluoroethylene (available as Teflon) or a metal such as soft copper or aluminum or fluted stainless steel. Rolled or fluted tubing is particularly attractive in that it can be readily pulled through the secondary pipeline. Preferably, while not illustrated, a leak detection system is operably connected to the annular space between the primary and secondary pipelines to detect the presence of leaked liquid, e.g. gasoline or ground water. Any leakage detection is conveyed to a monitoring station to alert the station owner/operator to the problem. Necessarily, all terminuses of both the primary pipeline and secondary pipeline of the double wall pipeline system are sealed in a liquid-tight manner.

The built-in safety shut-off valve assembly 10 is easy to install and is reliable. It is interposed between the primary pipeline 25 and the dispensing pipeline 28. The safety shut-off valve assembly comprises an open-top fuel flow chamber member 30, a removable cover plate 31 dimensioned to overlie the fuel flow chamber member 30 and a bonnet valve 32. The open-top fuel flow chamber member 30 is shown as permanently mounted in the concrete island structure 14. It is directly below the dispenser unit 11. The fuel flow chamber member 30 has a base and upstanding walls to form a chamber area 33 to hold fuel as further discussed below.

The removable cover plate 31 overlies the chamber area 33 of the fuel flow chamber member 30 and is bolted to it. A break-away tube member 34 extends from the cover plate 31. As shown, it is integral with the cover plate and extends vertically. Its lower terminus is an egress for fuel flowing through the fuel flow chamber member 30. Its upper terminus is connected to the dispensing pipeline and for this reason a set of internal threads are provided. As evident, a base 35 of the break-away tube member 34 above the cover plate 31 is thin walled so that any force exerted on the break-away tube member 34 will cause it to break or at least bend. The break-away tube member 34 can end at the cover plate or, as shown, extend downwardly from the cover plate's underside into the chamber area 33.

The cover plate 31 and break-away tube member 34 can be one-piece as shown with a mid-portion 36 of the cover plate 31 recessed downwardly to accommodate a trigger arm as described below. The cover plate 31 and break-away tube member 34 can also be two discreet structures which are joined together. For example, the cover plate 31 can have a centrally disposed threaded hole and the break-away tube member 34 be externally threaded. The one-piece integral structure is preferred because of an elimination of any sealing means which would be needed with a two piece structure to prevent fuel escaping from the chamber area 33.

The safety shut-off valve assembly 10 also includes the bonnet valve 32 to control the flow of fuel to the break-away tube member 34. The bonnet valve has a substantially flat plate disc 37 dimensioned to fully cover the terminus of the break-away tube member 34. In the open state, fuel freely flows through the opening of the break-away tube member 34 as it egresses the fuel chamber area 33. In the closed state, the plate disc 37 is urged into contact with the opening to prevent further fuel flow therethrough. The plate disc 37 has a lower annular lip 38 to receive and retain an upper end of a spring 40. It also has an approximately centered guide post 39 extending vertically. As evident in FIG. 2, the bonnet valve includes the spring 40 to urge the plate disc 37 upwardly upon activation. The spring 40 is positioned over a spring form tube 41 to hold a lower end in position. Other means of urging the plate disc of the bonnet valve to mate with the terminus of the break-away tube member 34 to close it off can be used.

The bonnet valve 32 also includes a trigger arm 43 which is mounted on the break-away tube member 34 and is operably associated with the plate disc 37 of the bonnet valve. It forces the plate disc 37 and spring 40 downwardly to permit flow of fuel through the primary pipeline, and into the dispensing pipeline of the dispenser unit.

The trigger arm 43 is a rod bent in a mid-section to give an approximate right angle with a first section 44 extending generally vertically along the break-away tube member 34 and a second section 45 extending generally horizontally into an interior area of the tube member. It is configured to normally hold the plate disc 37 of the bonnet valve down, yet move with the break-away tube member 34 in case of an accident so as to break contact with the plate disc 37. The trigger arm 43 has a looped end 46 at its upper terminus. A retention pin 47 secured to the break-away tube member 34 extends laterally and is used to receive the looped end 46. A hole 48 in the tube member's side wall receives the second section and along with the retention pin 47 holds the trigger arm in place. A seal 49 in the hole ensures no fuel leakage.

A set of guide arms 50 extend substantially horizontally inwardly from the lower terminus of the break-away tube member 34. The guide arms 50 receive the centered guide post 39 on the plate disc 37 to hold the bonnet valve in position.

It should be readily apparent that a bumping of sufficient force will cause the break-away tube member 34 to bend or break-off and then trip the trigger arm 43. This in turn releases the plate disc 37 of the bonnet valve to move upwardly into blocking contact with the break-away tube member terminus to effectively close off further liquid flow from the primary pipeline.

The trigger arm 43, at least in an exposed area, is optionally made of a meltable material such as solder. In case of a fire, the solder melts to release the bonnet valve.

Of particular importance, a complete unit is available which effectively prevents accidental spills. The chamber area 33 of the fuel flow chamber member 30 is substantially filled with gasoline and, because of a lack of sufficient oxygen, will not catch fire. At the same time, the chamber area can be emptied for ready access to the primary pipeline when needed.

As aforementioned, the safety shut-off valve assembly of the invention can be used with a primary pipeline which is the sole pipeline or with a primary pipeline which has a concentric secondary pipeline. In the later case, preferably an adaptor assembly is used. The adaptor assembly 60 depicted in FIG. 2 comprises a casing 61, a coupling 62 and a disengageable seal system 63. The casing 61 has an upper cylinder and a smaller diameter lower cylinder. The coupling 62 is a short tubular member which fits into a terminal end of the primary pipeline 25. A flared end is preferably provided for use of installation purposes. The coupling primarily acts as a rigid backing to prevent collapse of the primary terminus. The disengageable seal system 63 includes a compressible annular member 64 which provides a compression seal on both its inner wall surface which is in contact with the primary pipeline 25 and on its outer wall surface which is in contact with the casing 61. The annular member 64 is made of a compressible material, e.g. a synthetic elastomeric material and is dimensioned to fit at least partially into and substantially fill the space within the upper cylinder of the casing 61. An annular ram seat 65 fits over the coupling 62 and primary pipeline 25 and sits on top of the compressible annular member 64. The ram seat is an annular flat rigid member. A ram nut 66 is externally threaded to engage threads in the ingress opening in the fuel flow chamber 30 and to impart a force onto the ram seat 65 to hold the compressible annular member 64 in place during use. While not necessary, the ram seat 65 prevents the compressible annular member 64 from spreading outwardly or inwardly and is preferably used for this reason. Still other adaptor assemblies are described in U.S. Pat. No. 5,975,110 and are incorporated by reference herein.

In use, the dispenser unit having the safety shut-off valve assembly of the invention dispenses fuel as normal. Fuel flows from an underground storage tank through the primary supply pipeline to the dispenser's base. The fuel flows into fuel flow chamber and then continues to flow through the break-away tube member and into the dispensing pipeline. If the dispenser unit is bumped or otherwise disturbed, the bonnet valve is activated. That is, the plate member of the bonnet valve is urged into contact with the terminus of the break-away tube member to prevent egress of fuel into the dispenser unit.

When it is necessary to check and/or replace the primary pipeline, access to the safety shut-off valve assembly of the invention is readily gained, normally by an access panel on the dispenser unit. The cover plate is removed. The bonnet valve is then removed to reveal the primary pipeline. The primary pipeline can be disconnected at its terminuses and replaced if need be.

While several embodiments of the invention have been described in detail and with reference to the drawings, still other embodiments to accomplish the same purpose are contemplated. Such embodiments and all changes or modifications of an obvious nature are considered within the scope of the appended claims.

I claim:

1. A safety shut-off valve assembly for a fuel dispenser unit used to convey fuel from a bulk storage container through a primary pipeline while allowing periodic access to the primary pipeline and preventing an accumulation of fuel vapors in the dispenser unit, said assembly comprising:

(a) an open-top fuel flow chamber for permanent mounting at a base of the fuel dispenser unit, said open-top fuel flow chamber having an opening to receive an outlet terminus of the primary pipeline as ingress for fuel;

(b) a removable cover plate positioned on the open-top fuel flow chamber for closing off the fuel chamber;

(c) a break-away tube member extending from the removable cover plate for forming an egress for fuel in the fuel flow chamber to pass to a dispensing pipeline in the dispenser unit; and (d) a bonnet valve mounted in the open-top fuel flow chamber for allowing the free flow of fuel to pass from the primary pipeline to the dispensing pipeline and for shutting off the flow of fuel to the dispensing pipeline upon activation.

2. The safety shut-off valve assembly of claim 1 wherein the removable cover plate and the break-away tube member are integral.

3. The safety shut-off valve assembly of claim 2 wherein the break-away tube member extends generally vertically from the removable cover plate.

4. The safety shut-off valve assembly of claim 1 wherein the break-away tube member has a thin-walled base whereby a force directed against said break-away tube member will cause a breaking or bending at the thin-walled base.

5. The safety shut-off valve assembly of claim 1 wherein the bonnet valve has a plate disc dimensioned to fully cover the terminus of the break-away tube member.

6. The safety shut-off valve assembly of claim 5 wherein the break-away tube member has a retention pin extending laterally from a sidewall and the bonnet valve further comprises a trigger arm and a spring wherein the trigger arm is a bent rod having a first looped end positioned on the retention pin and a second end positioned to contact the plate disc and further wherein the spring exerts a force on the plate disc to urge it towards the terminus of the break-away tube member.

7. The safety shut-off valve assembly of claim 6 further wherein the plate disc of the bonnet valve has a approximately centered guide post extending vertically and the break-away tube member has a set of guide arms mounted near the terminus to receive the guide post of the plate disc to hold the bonnet valve in position.

8. The safety shut-off valve assembly of claim 6 wherein the trigger arm of the bonnet valve is made of solder which melts when exposed to fire.

9. A safety shut-off valve assembly for a fuel dispenser unit used to convey fuel from a bulk storage container to motor vehicles wherein periodic access to a primary pipeline leading from the bulk storage container to the dispenser unit is needed and wherein an accumulation of fuel vapors in the dispenser unit represents a hazardous condition, said assembly comprising:

(a) an open-top fuel flow chamber for permanent mounting at a base of the fuel dispenser unit, said open-top fuel flow chamber having an opening to receive an outlet terminus of the primary pipeline and to hold fuel;

(b) a removable cover plate for the open-top fuel flow chamber to close off the fuel chamber, said cover plate having a break-away tube member with a terminus through which fuel in the fuel flow chamber passes to a dispensing pipeline; and (c) a bonnet valve mounted in the open-top fuel flow chamber which allows the free flow of fuel to pass from the primary pipeline to the dispensing pipeline and which shuts off the flow of fuel to the dispensing pipeline upon activation, said bonnet valve having (i) a tube form mounted in the opening of the open-top fuel flow chamber, (ii) a spring positioned over the tube form; (iii) a plate disc positioned on the tube form so as to be urged upwardly by the spring, said plate disc dimensioned to fully cover the terminus in the break-away tube member so that fuel cannot pass into the break-away tube member when the bonnet valve is activated and (iv) a trigger arm pivotably mounted on the break-away tube member and operably associated with the plate disc to urge said plate disc downwardly away from the terminus of the break-away tube member, whereby the plate disc of the bonnet valve is normally urged away from the break-away tube member terminus so that fuel can freely egress from the fuel chamber to the break-away tube member and when the bonnet valve is activated by movement of the trigger arm said plate disc is urged fully upwardly by the spring to close off the terminus of the break-away tube member to stop further flow of fuel from the flow chamber.

10. A safety shut-off valve assembly for a fuel dispenser unit, said assembly comprising:

(a) an open-top fuel flow chamber for permanent mounting at a base of the fuel dispenser unit, said open-top fuel flow chamber having an opening to receive an outlet terminus of the primary pipeline as ingress for fuel;

(b) a removable cover plate for the open-top fuel flow chamber to close off the fuel chamber, said cover plate having extending therefrom a break-away tube member with a sidewall and with a terminus for forming an egress for fuel in the fuel flow chamber to pass to a dispensing pipeline in the dispenser unit, further said break-away tube member having a retention pin extending laterally from the sidewall; and (c) a bonnet valve mounted in the open-top fuel flow chamber for allowing the free flow of fuel to pass from the primary pipeline to the dispensing pipeline and for shutting off the flow of fuel to the dispensing pipeline upon activation, said bonnet valve comprising (i) a plate disc dimensioned to fully cover the terminus of the break-away tube member, (ii) a trigger arm pivotally mounted on the break-away tube member and operably associated with the retention pin on said break-away tube member and with the plate disc for urging the plate disc downwardly away from the terminus of the break-away tube member to normally allow fuel to freely flow from the open-top fuel flow chamber, and (iii) a spring for exerting a force on the plate disc to urge it fully upwardly towards the terminus of the break-away tube upon activation to stop further flow of fuel from the open-top fuel flow chamber.

11. The safety shut-off valve assembly of claim 10 wherein the removable cover plate and the break-away tube member are integral.

12. The safety shut-off valve assembly of claim 11 wherein the break-away tube member extends generally vertically from the removable cover plate.

13. The safety shut-off valve assembly of claim 10 wherein the break-away tube member has a thin-walled base whereby a force directed against said break-away tube member will cause a breaking or bending at the thin-walled base.

14. The safety shut-off valve assembly of claim 13 wherein the trigger arm of the bonnet valve is a bent rod having a first looped end positioned on the retention pin of the break-away tube member and a second end positioned to contact the plate disc.

15. The safety shut-off valve assembly of claim 14 further wherein the plate disc of the bonnet valve has a approximately centered guide post extending vertically and the break-away tube member has a set of guide arms mounted within its interior to receive the guide post of the plate disc to hold the bonnet valve in position.

16. The safety shut-off valve assembly of claim 15 wherein the trigger arm of the bonnet valve is made of a solder capable of melting when exposed to fire.

* * * * *